US009610601B2

(12) United States Patent
Abt et al.

(10) Patent No.: US 9,610,601 B2
(45) Date of Patent: Apr. 4, 2017

(54) PAINT SPRAYING DEVICE

(71) Applicant: J. Wagner GmbH, Markdorf (DE)

(72) Inventors: Andreas Abt, Frickingen (DE); Christopher J. Sulzer, Minneapolis, MN (US)

(73) Assignee: J. Wagner GmbH, Markdorf (DE)

( * ) Notice: Subject to any disclaimer, the term of this patent is extended or adjusted under 35 U.S.C. 154(b) by 65 days.

(21) Appl. No.: 14/680,509

(22) Filed: Apr. 7, 2015

(65) Prior Publication Data

US 2015/0283568 A1 Oct. 8, 2015

(30) Foreign Application Priority Data

Apr. 8, 2014 (DE) ..... 10 2014 104 982

(51) Int. Cl.

| | |
|---|---|
| ***B05B 1/28*** | (2006.01) |
| ***B05B 12/08*** | (2006.01) |
| ***B05B 9/01*** | (2006.01) |
| ***B05B 1/30*** | (2006.01) |
| ***B05B 7/00*** | (2006.01) |
| ***B05B 7/08*** | (2006.01) |

(52) U.S. Cl.

CPC ..... *B05B 12/088* (2013.01); *B05B 1/3046* (2013.01); *B05B 7/0081* (2013.01); *B05B 7/0815* (2013.01); *B05B 9/01* (2013.01); *Y10T 137/782* (2015.04)

(58) Field of Classification Search

CPC . B05B 12/088; B05B 7/0081; B05B 7/00815; B05B 9/01; B05B 1/3046; Y10T 137/782

USPC ..... 239/525, 526, 290, 296, 583, 586

See application file for complete search history.

(56) References Cited

U.S. PATENT DOCUMENTS

| | | | | |
|---|---|---|---|---|
| 3,720,373 | A | 3/1973 | Levey | |
| 4,682,710 | A * | 7/1987 | Turner, Jr. | B05B 9/0406 239/76 |
| 5,060,866 | A | 10/1991 | Carlzon | |
| 5,100,060 | A | 3/1992 | Haferkorn | |
| 2003/0041884 | A1 | 3/2003 | Bahr | |
| 2011/0073677 | A1 | 3/2011 | Hahn et al. | |
| 2012/0261500 | A1 | 10/2012 | Krayer et al. | |

FOREIGN PATENT DOCUMENTS

| | | |
|---|---|---|
| DE | 2 019 373 A | 10/1970 |
| DE | 90 05 155 U1 | 7/1990 |
| DE | 42 21 156 A1 | 1/1994 |

(Continued)

OTHER PUBLICATIONS

European Search Report, European Application No. 15162371.7, dated Aug. 24, 2015 (7 pages).

(Continued)

*Primary Examiner* — Steven J Ganey

(74) *Attorney, Agent, or Firm* — Burr & Brown, PLLC

(57) ABSTRACT

The invention relates to a paint spraying device with a spray head which dispenses a quantity of paint via a needle valve and a paint-dispensing line leading to the spray head, wherein the paint-dispensing line is connected upstream of a pressure reducer/pressure regulator which regulates the paint-dispensing pressure and holds the pressure in the paint-dispensing line to the spray head substantially constant.

21 Claims, 6 Drawing Sheets

(56) References Cited

FOREIGN PATENT DOCUMENTS

| | | | |
|---|---|---|---|
| DE | 101 40 216 | A1 | 3/2003 |
| EP | 1 084 760 | A2 | 3/2001 |
| FR | 2 270 011 | A | 12/1975 |
| GB | 1 288 141 | A | 9/1972 |
| GB | 1 490 427 | A | 11/1977 |
| WO | 97/03756 | | 2/1997 |
| WO | 2011/038712 | A1 | 4/2011 |

OTHER PUBLICATIONS

U.S. Appl. No. 14/680,474, filed Apr. 7, 2015, Christopher Sulzer.
German Search Report (Application No. 10 2014 104 982.9) dated Dec. 19, 2014.

* cited by examiner

PAINT SPRAYING DEVICE

This application claims the benefit under 35 USC §119 (a)-(d) of German Application No. 10 2014 104 982.9 filed Apr. 8, 2014, the entirety of which is incorporated herein by reference.

FIELD OF THE INVENTION

The invention relates to a paint spraying device.

BACKGROUND OF THE INVENTION

The prior art contains a multiplicity of air-operated paint spraying devices which generally comprise a paint reservoir, a device for generating an air flow, for example, a compressor or a blower and a spray gun.

In the case of what are termed HVLP systems (high volume, low pressure), the paint is atomized by means of an air blower through a high volume flow rate of air at a low pressure at a spray head. To that end, the paint is provided at the spray head either by means of a conveying air pressure or otherwise. The quantity of paint dispensed is generally regulated by a needle valve and a trigger mechanism. The air blower and the paint supply are integrated either into the pistol unit or alternatively individually or together in a base station. Such an HVLP atomization is for example mentioned in US 2011/0073677 A1. A transportable spray device with an operating unit, a paint spraying lance and a spray head and separate paint reservoir is described in WO 2011/038712 A1.

In order to convey the paint from a paint reservoir which is remote from a paint spraying gun to the paint spraying gun, in particular, in the case of high-viscosity paints, substantial pressures are required. The required conveying pressure is then dictated, in particular, by the length of the line used and the cross section thereof. The spraying process at the spray head itself should, however, take place with an appropriately low pressure in order to avoid an uncontrolled egress of paint, known as "spitting", upon opening a needle valve on the spray head. If this is not done, the application of paint is uneven on account of variations in the quantity of atomizable paint dispensed at the paint spraying head. In the prior art, this effect is avoided by switching the paint conveying on and off according to the quantity of paint to be dispensed. However, this requires complex and rapid switching processes which make the relevant devices complicated, susceptible to faults and expensive.

SUMMARY OF THE INVENTION

The present invention is based on the object of proposing a paint spraying device which generates as even an application of paint as possible while having a more economical construction.

According to the present invention, the object is achieved in that, on a spray gun or the like, a pressure reducer or a pressure regulator is connected upstream of the paint-dispensing line which supplies a spray head with paint, such that the paint pressure in the paint-dispensing line is held substantially constant.

In order to pump the high-viscosity paint through, for example, an approximately 7 m-long supply hose, pump pressures of up to approximately 8 bar are often required. This high pump pressure has to be reduced to a very low value at the spray head, to which end a special pressure reducer is provided. This is in particular critical when the spraying process is interrupted, and thus the high supply pressure builds up in the entire system, since there is no continuous paint removal and associated pressure drop. If the paint pressure acting at the spray head is held as constant as possible at a low value, "spitting" of the gun is reliably prevented.

To that end, according to the invention, the pressure reducer is arranged downstream of a paint supply line and upstream of a paint dispensing line.

Within the context of the invention, a paint supply line is to be understood as a line which is provided for the supply of paint to the inlet of a paint-dispensing device, for example, to a spray gun or a paint inlet line of such a device. In that context, such a paint supply line can be up to 8 m long. Within the context of the invention, a paint supply line can for example be designed as a paint hose.

Within the context of the invention, a paint-dispensing line is to be understood as a line which is provided for supplying paint to the outlet of a paint-dispensing device, for example a spray gun. Within the context of the invention, the paint-dispensing line is arranged within a paint-dispensing device, for example a spray gun.

In one preferred embodiment, it is provided that the pressure reducer/pressure regulator comprises a paint inlet line for supplying paint at high pressure and a paint outlet line for supplying paint at an essentially constant lower pressure. The two lines are connected to one another via a pressure reducer housing, wherein the pressure reducer housing has a preferably annular or circular internal space with a diaphragm plate arranged therein. In that context, the diaphragm plate has means which change, in a pressure-dependent manner, the cross section of the paint inlet line or the cross section of the inlet to the preferably annular internal space in the manner of a throttle in the paint inlet line.

Cross section changes to a pressurized paint inlet line have the effect of reducing the pressure, according to known physical principles (force per unit area, hydrostatic paradox). The preparation of corresponding means for changing the cross section of a paint inlet line at a pressure reducer housing by means of a diaphragm plate arranged in that housing has the advantage that, using simple mechanical means, the pressure acting inside the housing is fed back to the inlet cross section of the paint inlet line, and thus no additional control loops are required.

In a further preferred embodiment, it is provided that a spring or the like, whose preload is preferably adjustable, presses on the rear side of the diaphragm plate with an annular pressure diaphragm, on its side oriented away from the paint supply line.

The fact that a pressure acts on the diaphragm plate on its side oriented away from the paint sets with precision the setpoint internal space pressure and makes it possible, in the event that the preload is also designed to be adjustable, to select the internal space pressure according to the required parameters.

In a further expedient embodiment, it is provided that a front side of the diaphragm plate, upon which the pressure of paint to be supplied acts, is connected via a piston rod to a closure element, in particular a cross slide for the cross section of the paint inlet line, wherein the closure element changes, or reduces to a lower pressure, the cross section of the paint inlet line according to a deformation of the diaphragm and an associated movement of the diaphragm plate.

The direct coupling of the diaphragm plate via a piston rod with a closure element regulates, depending on the internal pressure of the internal space, the cross section of the paint inlet lines and thus has the result, according to the known physical principles, that only a proportion—corresponding to the open cross section area—of the pressure in the paint inlet line is transmitted into the internal space.

A development which is expedient in this regard provides that the position of the closure element relative to the piston rod can be adjusted, and in particular can be set by means of a thread. Depending on the viscosity properties of the paint, it can be expedient to change the ratio of the internal pressure to the open cross section of the paint inlet line, which is brought about by changing the relative position of the closure element to the piston rod. It is thus possible, for example, to bring about an increased internal pressure and thus an increased pressure on the paint outlet line at the pressure reducer/pressure regulator.

It is moreover expedient that the diaphragm plate is formed as an umbrella-shaped element with a moulded-on piston rod and consists of a rigid material and at least partially receives a diaphragm which is flexible in comparison with the rigid material or a diaphragm is attached to the diaphragm plate, wherein the diaphragm forms, in the outer region of the diaphragm plate, a flexible section for sealing the in particular annular internal space with respect to a housing cover.

The diaphragm plate, which together with the diaphragm acts as a pressure receiver for the pressure in the internal space of the housing, is held in its rim region by the corresponding diaphragm such that it can move, without a substantial influence on or change to the pressure-force ratios in the internal space being necessary for moving the diaphragm unit consisting of the diaphragm plate and the diaphragm.

In an expedient development it is provided to form the closure element with at least one, preferably two, seal elements. The seal elements can in this context be arranged in a recess, in particular as O-rings.

A further expedient development provides that a structure which stands proud from a face is arranged in the region of the internal space, wherein the structure, as a flow deflector or flow collar or the like, at least partially surrounds a paint inlet opening and generates a flow for continuously circulating the paint in the interior when the paint spraying device is in operation or is being cleaned. This avoids paint lingering in the region of the pressure reducer/pressure regulator and possibly drying, or the formation of quiescent regions which are not exposed to the paint flow.

It is further provided that a flexible diaphragm is circumferentially attached, in particular clamped or welded, between a housing lower part of the pressure reducer and a housing cover of the pressure reducer.

The flexible diaphragm, which is clamped between two housing constituents of the pressure reducer housing or is held in a similar manner, serves as an attachment for the diaphragm plate which in turn operates the means for changing the cross section of the paint inlet line. It is thus possible to simply separate the paint region from a rear-side region which for example comprises a spring for providing a counter-force.

It is moreover expediently provided that the closure element is formed as a slide or valve element with an internal duct.

In this embodiment, the closure element permits either a cross section change by direct effect on the duct cross section of the paint inlet line, or a cross section change by means of a relative displacement of two ducts with respect to one another, as is, for example, effected in conventional ball valves or the like.

It is further provided, in an expedient embodiment of the paint spraying device according to the invention, to form the pressure reducer as an exchangeable subassembly, in particular as a subassembly with a screw connection and/or a quick-action fastener to the paint inlet line and/or the paint outlet line. The pressure reducer, which can attract dirt or dried-on paint on account of its moving parts and the possibly narrow cross sections, can be formed as an exchangeable subassembly, in particular as a single-use part, in order not to reduce the lifespan of the entire paint spraying device.

It is moreover advantageously provided that the diaphragm plate and/or the diaphragm is formed as a one-piece component, in particular as an injection-moulded component, wherein in particular rigid constituents are formed with thick walls and flexible constituents are formed with thin walls and/or the diaphragm has, in its outer rim region, a bead or a clamping rim.

The diaphragm plate and the diaphragm can be produced in one piece (especially from plastic) e.g. by means of a plastic injection moulding method. In that context, elastic parts are created with thin walls, rigid parts are created with thick walls, and are thus respectively given the desired property and elasticity. Threads can also be moulded thereon. Preferably, the outermost diaphragm circumference is made thicker in order to stabilize the attachment/clamping in the housing. Moreover, an undulation, which establishes in a defined manner what will later be the deformation region, can be imparted to the cross section of the diaphragm.

In addition to spraying paint, also known is a paint applying device for applying paint to a substrate, for example a paint roller, a paintbrush, a paint pad or the like, wherein the paint applying device is supplied with paint via a paint reservoir by means of a paint pump. According to the invention, it is also possible in this case to provide that a pressure reducer/pressure regulator is arranged according to that set out in the preceding description of the invention.

For the purpose of a more detailed explanation of the embodiment according to the invention, and of the expedient developments, exemplary embodiments are presented below.

For the purpose of the desired paint application, an essentially constant paint pressure, in particular conventionally a reduced pressure at approximately 0.3 to 0.4 bar, is to be striven for in order to generate an even spray pattern.

BRIEF DESCRIPTION OF THE DRAWINGS

For a fully understanding of the nature and objects of the invention, reference should be made to the following detailed description of a preferred mode of practicing the invention, read in connection with the accompanying drawings.

DETAILED DESCRIPTION OF THE INVENTION

Figure 1:
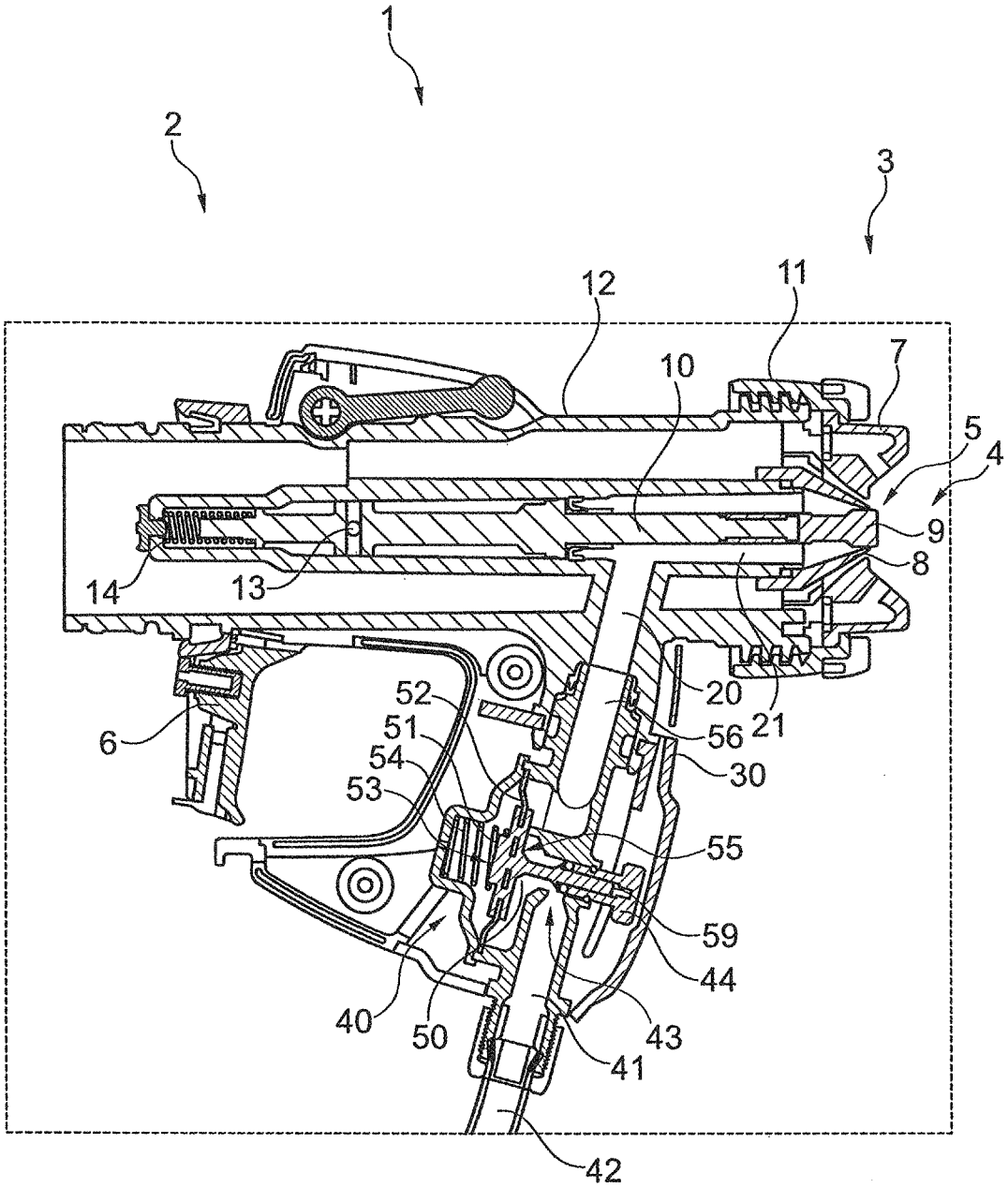
FIG. 1 shows, in section, a paint spraying device with a spray head and a spray nozzle, along with the associated pressure reducer/pressure regulator.

FIG. 1 shows a paint spraying device 1 as what is termed the front end 2 of a paint spray gun. Such constructions are known from a multiplicity of appliances produced by the applicant. In that context, what is termed the front end, as a subassembly which contains the paint-conveying constituents, is releasably connected to a further subassembly which for example bears the blower or comprises the air supply line, thus generating degrees of flexibility by means of exchangeable front ends. The paint spraying device comprises a spray head 3 with a front paint nozzle 4 which is actuated by means of a needle valve 5 via a trigger 6. The spray head 3 then forms, by means of an air cap 7 and an air gate 8, an atomizing nozzle which can be opened or closed by means of the needle head 9 of the needle 10 of the needle valve 5. The system of the spray head 3 is fixed and held on the body 12 by the union nut 11. The needle 10 is drawn back by the trigger 6 via a bolt 13 against a spring 14 and can then dispense paint through the spray head 3, in the manner of a paint spray gun.

If the needle valve 5 remains closed, a certain internal pressure builds up inside the paint-conveying constituents of the paint spraying device 1, that is to say in the volume around the needle 10, in the paint-dispensing line 20 and in the paint-dispensing space 21, which pressure, in addition to the atomizing effect of the air atomization, allows the paint to issue forth from the needle valve 5 when the needle valve 5 is re-opened. If this internal pressure is too high, the paint spraying device spits out the first paint drops, which leads to undesired results.

Below the spray head 3 there is provided a connection housing 30 for the supply of paint and for receiving a pressure reducer/pressure regulator 40 (in the following just pressure reducer).

The pressure reducer 40 comprises a paint inlet line 41 to which the paint supply line 42 is connected via a connection hose. The cross section 43 of the paint inlet line 41 narrows at the pressure reducer, with a closure element 44 being arranged at this point.

An internal space 50 of the pressure reducer 40 is connected to the narrowed cross section location 43, in which space there is in turn arranged a diaphragm plate 51 which acts on the closure element 44 via a piston rod 59. The diaphragm plate 51 is suspended laterally circumferentially on a diaphragm 52 and its rear side 53 is supported by a spring 54.

Thus, via the diaphragm plate 51 and the diaphragm front side 55, a paint pressure prevailing in the internal space 50 will move the diaphragm plate 51, and thus the closure element 44 via the piston rod 59, in the direction of the spring 54 until the pressure force of the paint from the internal space 50 is compensated for by the spring force of the spring 54. At the same time, the closure element 44 closes the cross section 43 and thus reduces the transfer of pressure from the paint supply line 42 via the paint inlet line 41 into the internal space 50. By means of this interaction, the pressure in the internal space 50 remains essentially constant.

The paint-dispensing line 20 opens into the paint outlet line 56 which connects to the internal space 50, via which paint-dispensing line the paint is then transferred to the paint-dispensing space 21 at a constant, reduced pressure with respect to the inlet side.

Figure 2A:
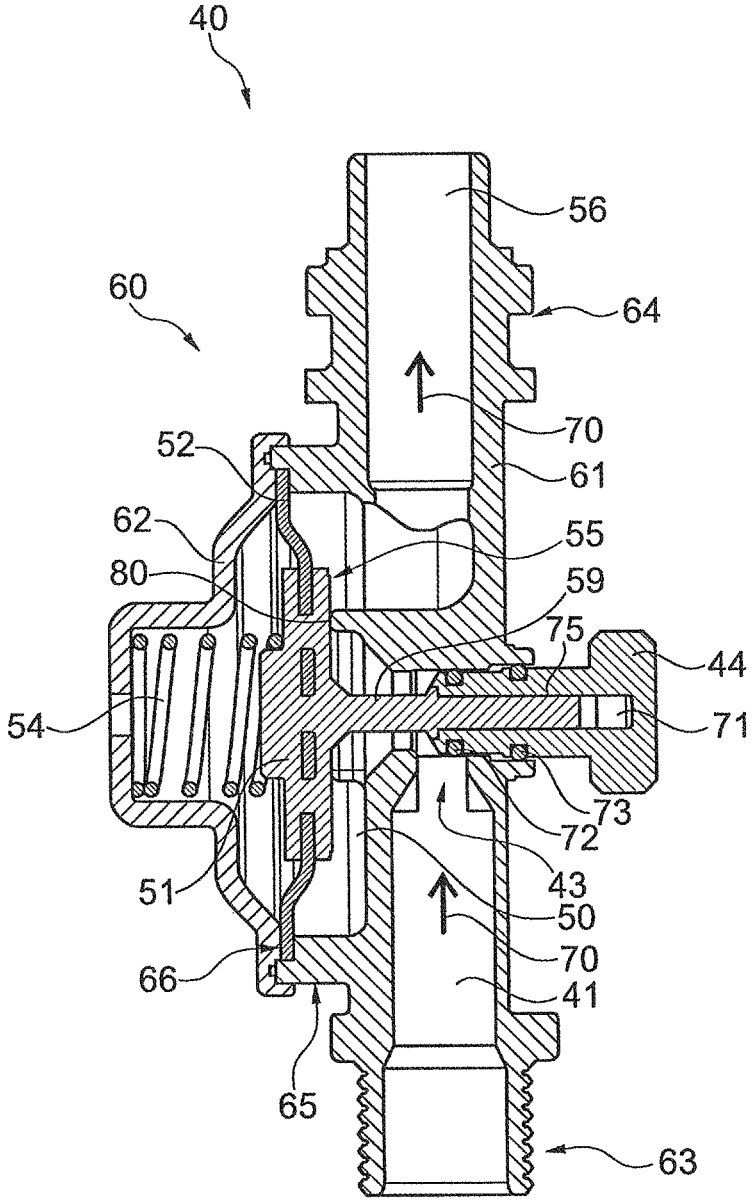
FIGS. 2*a* to 2*c* show a pressure reducer according to the invention in various closing positions of the paint inlet line.
Figure 2B:
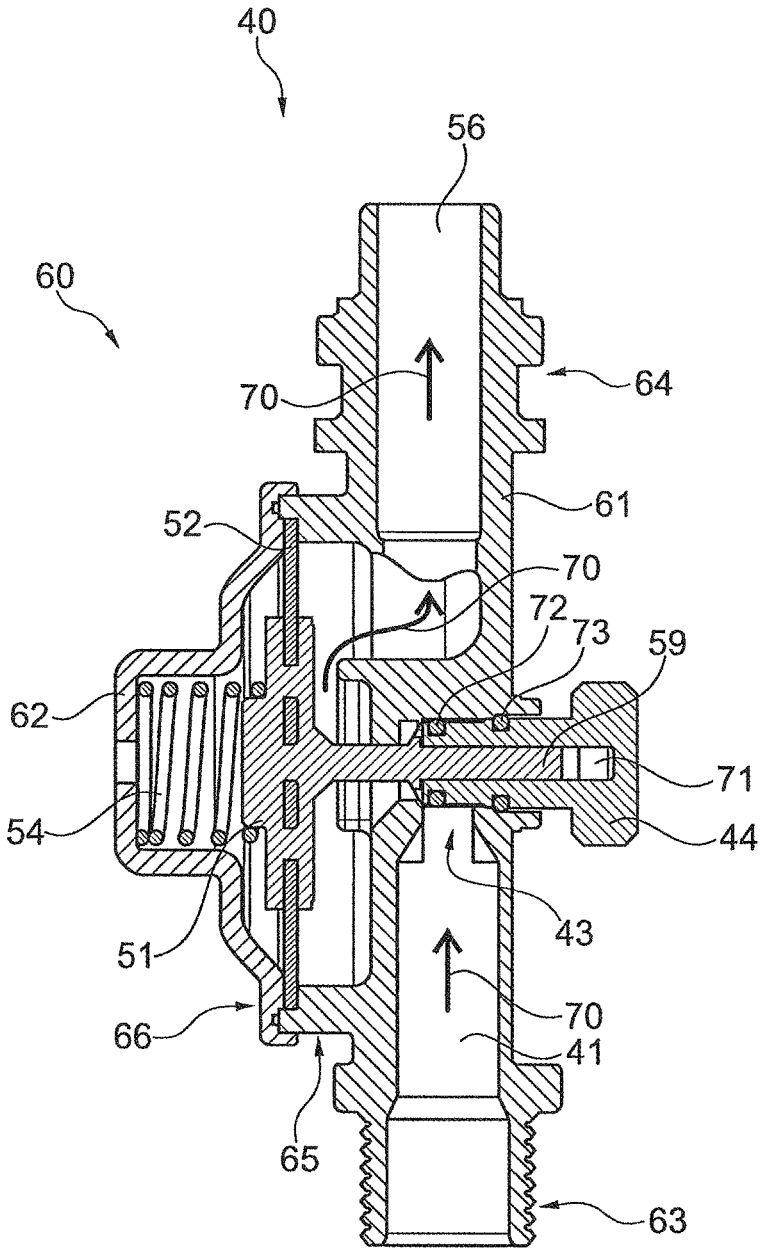
Figure 2C:
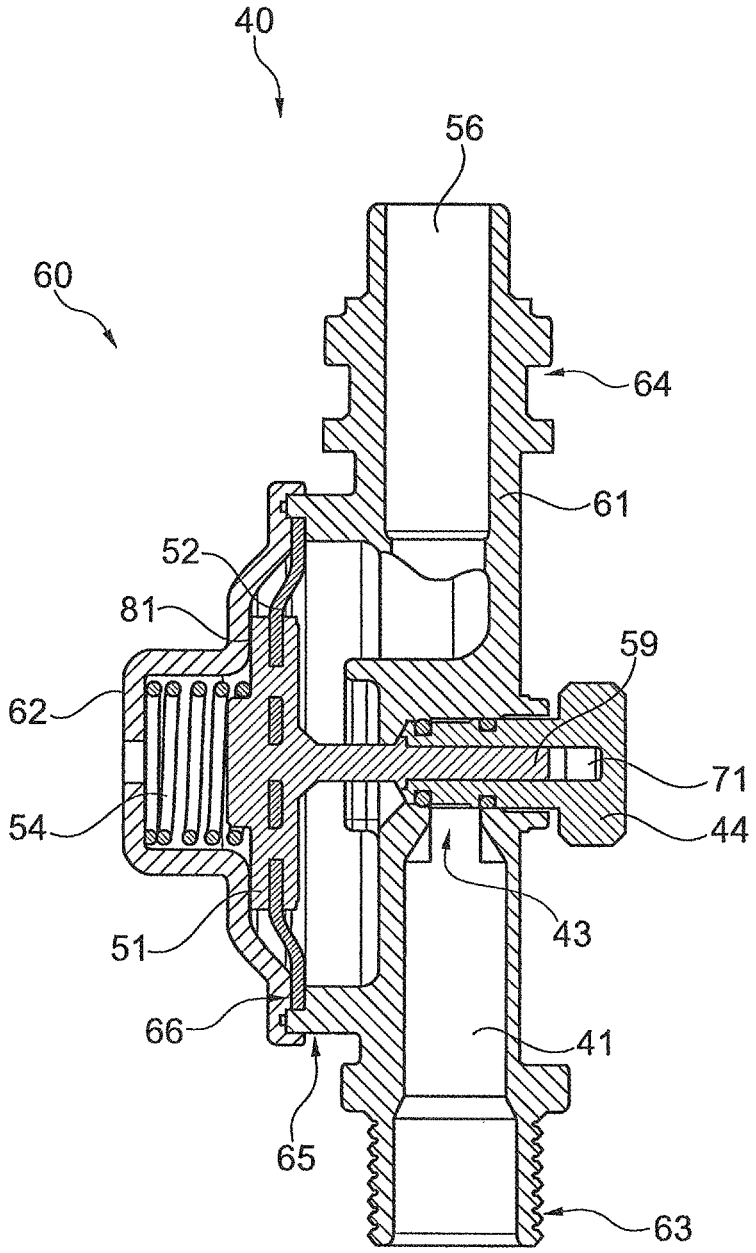

FIGS. 2*a* to 2*c* show the pressure reducer 40 in an isolated sectional representation. In that context, FIG. 2*a* shows the open state, FIG. 2*b* shows the state in the intermediate regulated operation and FIG. 2*c* shows the closed state. The constituents are provided with the same reference signs as were introduced in the description relating to FIG. 1.

The pressure reducer housing 60 represented in FIGS. 2*a* to 2*c* comprises a housing lower part 61 and a housing cover 62. The paint supply line 42 (not shown) is attached by means of a screw-thread connection 63 according to the representation in FIG. 1. The upper side of the pressure reducer 40 is connected, at its paint outlet line 56, to the paint-dispensing line 20 in the paint spraying device 1 by means of a quick-action fastener 64, in the present case in the form of a form-fitting latching connection.

The pressure reducer housing 60 represented in FIGS. 2*a* to 2*c* comprises a pressure regulating device by means of a diaphragm 52 control. To that end, a diaphragm plate 51, which comprises an annular pressure diaphragm 52, is arranged in a lateral housing projection 65 with a pot-shaped housing cover 62. The annular pressure diaphragm 52 is attached by means of a clamping 66 between the housing projection 65 and the pot-shaped housing cover 62. The diaphragm plate 51 with the annular pressure diaphragm 52 thus delimits an annular internal space 50 through which flows the paint to be conveyed.

The diaphragm plate 51 comprises, on its front side 55 oriented towards the internal space 50, a piston rod 59 which extends transversely to the paint throughflow direction 70. The piston rod 59 is connected in a receiving bore 71, on its side oriented away from the diaphragm plate 51, to a closure element 44. The closure element 44 is formed as a type of cross slide and is mounted within the pressure reducer housing 60 perpendicular to the throughflow direction 70. Mounting and sealing in the transverse direction is achieved by means of two O-rings 72, 73 which surround the cylindrical part of the closure element 44. By means of the receiving bore 71, with the threaded rod 75 of the piston rod 59 therein, it is possible to change the starting position of the closure element 44 with respect to the piston rod 59. This changes the separation between the diaphragm plate 51 and the closure element 44 having the effect of changing a throttling of the paint flow.

The cylindrical body of the closure element 44 serves to change the inlet cross section 43 of the paint inlet line 41 to the annular internal space 50 of the housing projection 65 of the pressure reducer housing 60.

The movement of the piston rod 59, represented in FIGS. 2*a* to 2*c*, opens and closes the cross section 43. FIG. 2*a* shows one type of open position, FIG. 2*b* shows a position of the closure element 44 at the beginning of the closed position and FIG. 2*c* shows the closed position of the cross section 43. In this position, the O-rings 72, 73 completely seal off the internal space 50 from the paint inlet line 41 by means of the closure element 44.

The transverse movement of the piston rod 59 moves the diaphragm plate 51 from the open position in FIG. 2*a* to the closed position of the cross section 43 in FIG. 2*c*. In order to generate a counter-pressure, and hence to carry out the reverse movement, the pot-shaped housing cover 62 has a coil spring 54 which presses the diaphragm plate 51 and thus the annular diaphragm 52 in the opposite direction, that is to say in the direction of the closure element 44. In that context, the coil spring can be made to have an adjustable preload.

FIG. 2*a* shows, inside the housing projection 65, a first endstop 80 against which the diaphragm plate 51 presses sideways in one of its end positions, and a second endstop 81 in FIG. 2*c* on the pot-shaped housing cover 62.

Figure 3:
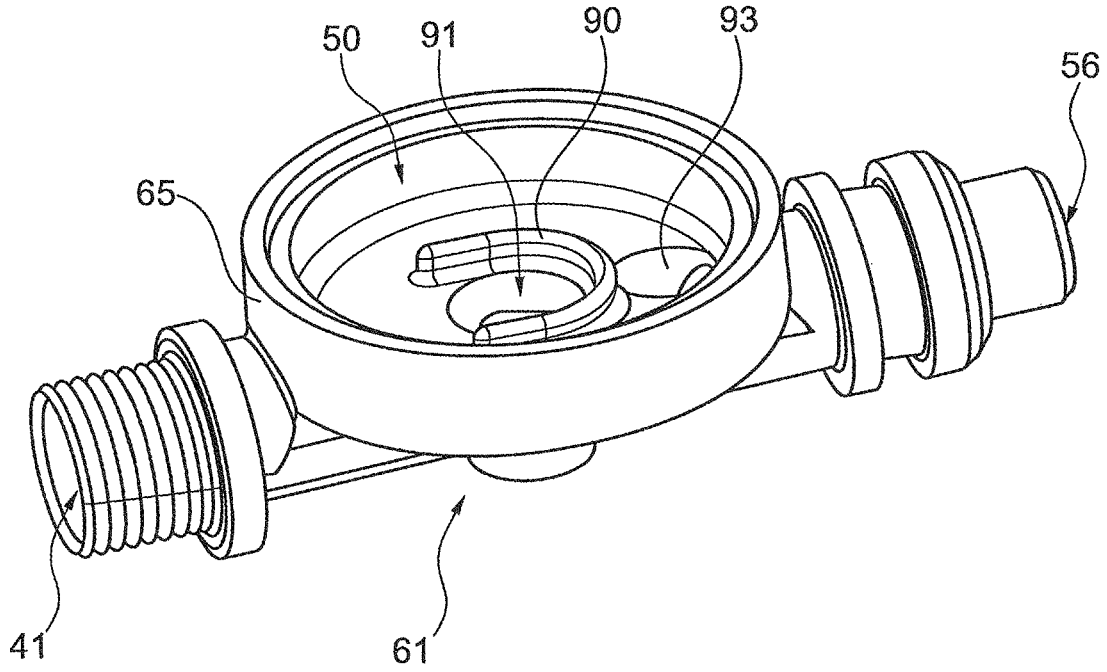
FIG. 3 shows a view of part of the pressure reducer housing, in various views.

The housing lower part 61 with the housing projection 65 is again represented separately in FIG. 3. FIG. 3 shows the housing projection 65 without the diaphragm plate. Particularly visible is a U-shaped web in the form of a flow collar 90, which partially surrounds the inlet opening 91 of the paint inlet line 41, the closure element 44 being movably arranged in the inlet opening. When the paint enters from the paint inlet line 41 into the annular internal space 50 through the inlet opening 91, the paint is deflected by the U-shaped flow collar 90 and flows from the annular internal space 50 into the opening 93 for the paint outlet line 56. The U shape of the flow collar 90 within the pressure reducer 40 also serves to generate turbulence during cleaning (for example with water), such that the entire pressure reducer is flushed through; at the same time, this also avoids, during operation with paint, fluidic dead spaces in which for example crumbs of paint could be deposited.

Figure 4:
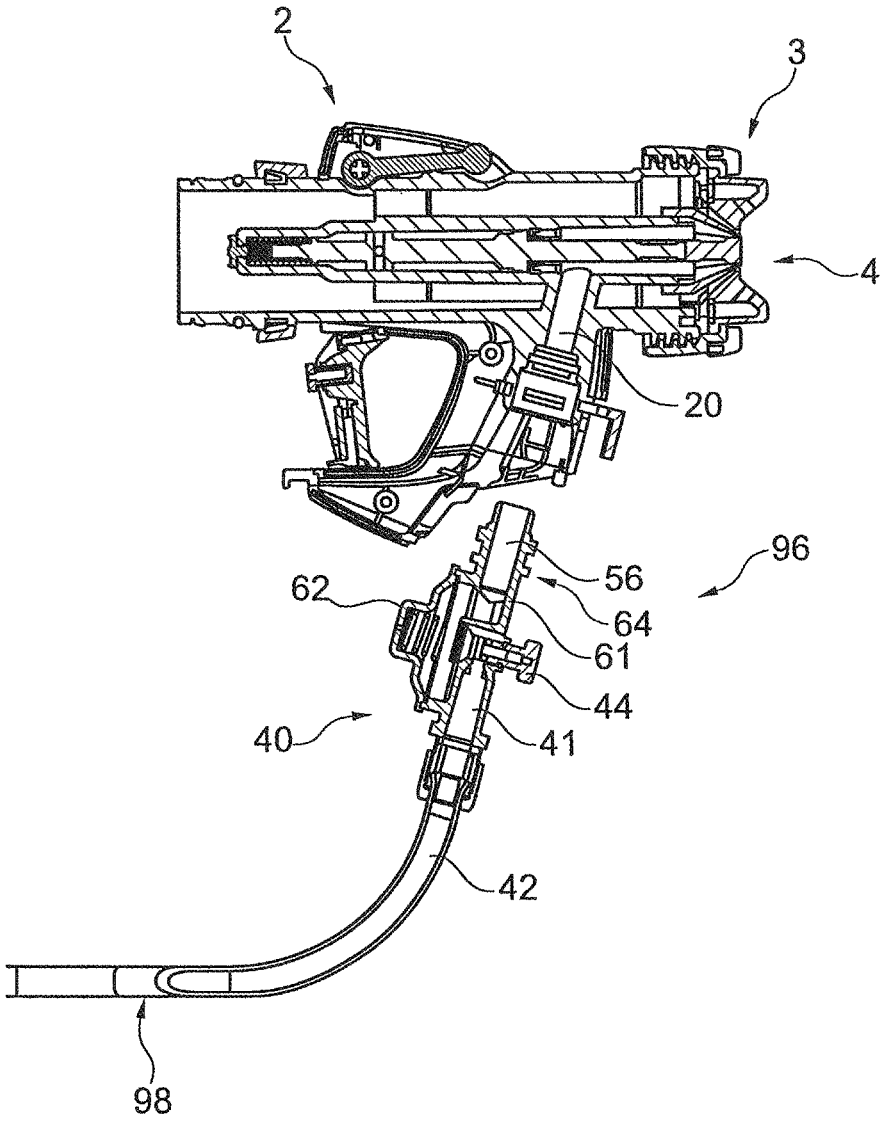
FIG. 4 shows a paint spraying device with a pressure reducer/pressure regulator having a modular construction as a subassembly.

FIG. 4 shows, by way of example, the construction of the pressure reducer 40 as a subassembly 96 which can be located on a front end 2. In this manner, the pressure reducer can be exchanged and can be adapted to the physical properties of the paint to be processed, or can be easily exchanged in the event of fouling.

On the Mode of Operation of the Pressure Reducer:

The paint spraying device is operated with a reduced pressure of approximately 0.3 to 0.4 bar. The paint is supplied via a supply hose or connection hose of the paint spraying device, which hose is for example approximately 7 m long. A high pump pressure of for example 8 bar is required at the paint reservoir (not shown) in order to pump the high-viscosity paint through this long supply hose 98.

The pressure reducer according to the invention now serves to reduce the high pressure of up to 8 bar prevailing in the paint supply line 42 to a lower pressure of approximately 0.3 to 0.4 bar required in the paint-dispensing line 20. This is in particular necessary in the event of an interruption of the paint dispensing, for example in the case of a work break, in order to ensure the quality of the paint application.

In comparison with arrangements which, in addition to the pressure reduction or pressure regulation, comprise a paint return line into a paint reservoir in order to regulate a dynamic pressure by means of circulating paint, the present invention achieves this in particular with just one paint supply line and just one paint-dispensing line.

Within the context of the invention, a needle valve is to be understood as any type of needle valve, including those with a needle head which deviates from a rotationally symmetric head shape, as are known from the applicant's inventions.

Within the context of the invention, an annular or circular internal space is to be understood as that internal space which is formed in a substantially annular fashion about a paint inlet. In that context, it is immaterial whether what is in fact formed is a ring with a centrally located interruption of the space, or whether there is a circular cavity with an inlet duct located in the centre without an interruption.

The invention is not restricted to the represented and described exemplary embodiment. Rather, it also encompasses all variants within the scope of the patent claims.

LIST OF REFERENCE SIGNS

1 Paint spraying device
2 Front end
3 Spray head
4 Paint nozzle
5 Needle valve
6 Trigger
7 Air cap
8 Air gate
9 Needle head
10 Needle
11 Union nut
12 Body
13 Bolt
20 Paint-dispensing line
21 Paint-dispensing space
30 Connection housing
40 Pressure reducer/pressure regulator
41 Paint inlet line
42 Paint supply line
43 Cross section
44 Closure element
50 Internal space
51 Diaphragm plate
52 Diaphragm
53 Rear side
54 Spring
55 Front side
56 Paint outlet line
59 Piston rod
60 Housing
61 Housing lower part
62 Housing cover
63 Thread-screw connection
64 Quick-action fastener
65 Housing projection
66 Clamping
70 Throughflow direction
71 Receiving bore with internal thread
72 O-ring
73 O-ring
75 Threaded rod
80 Endstop
90 Flow collar
91 Inlet opening
93 Opening
96 Subassembly

The invention claimed is:

1. A paint spraying device comprising:

a spray gun;

a spray head which dispenses a quantity of paint via a needle valve;

a pressure reducer/pressure regulator having a paint inlet line for supplying paint at high pressure and a paint outlet line for supplying paint at an essentially constant lower pressure such that the paint inlet line is connected to the paint outlet line via a pressure reducer housing; and a paint-dispensing line leading to the spray head, wherein the pressure reducer/pressure regulator which regulates the paint-dispensing pressure is connected upstream of the paint-dispensing line, and wherein the pressure in the paint-dispensing line is held substantially constant by the pressure reducer/pressure regulator.

2. The paint spraying device according to claim 1, wherein in the pressure reducer housing, there is provided a diaphragm plate or a diaphragm support which changes, in a pressure-dependent manner, a cross section of the paint inlet line in the manner of a throttle in the paint inlet line.

3. The paint spraying device according to claim 2, wherein the pressure reducer housing has an annular internal space having an inlet such that a cross section of the inlet to the annular internal space is changed by the diaphragm plate or the diaphragm support.

4. The paint spraying device according to claim 1, wherein a spring/coil spring has a preload that presses on a rear side of a diaphragm plate with an annular pressure diaphragm, on the diaphragm plate side oriented away from the paint supply line.

5. The paint spraying device according to claim 4, wherein the preload of the spring/coil spring is adjustable.

6. The paint spraying device according to claim 1, wherein a front side of a diaphragm plate, upon which the pressure of the paint to be supplied acts, is connected via a piston rod to a closure element, which is formed as a cross slide for a cross section of the paint inlet line, wherein the closure element reduces the cross section of the paint inlet line according to a deformation of a diaphragm and an associated movement of the diaphragm plate.

7. The paint spraying device according to claim 6, wherein the closure element reduces to closure the cross section of the paint inlet line according to the deformation of the diaphragm and the associated movement of the diaphragm plate.

8. The paint spraying device according to claim 1, wherein a position of a closure element relative to a piston rod can be adjusted via a threaded connection, wherein a cross slide has a receiving bore with internal threads for the piston rod, wherein the piston rod is formed, at least along sections of its length, as a threaded rod.

9. The paint spraying device according to claim 1, wherein a diaphragm plate is formed as an umbrella-shaped element with a moulded-on piston rod and consists of a rigid material and at least partially receives a diaphragm which is flexible in comparison with the rigid material or a diaphragm is attached thereto, such that the diaphragm forms, in the outer region of the diaphragm plate, a flexible section for sealing an annular space with respect to a housing cover.

10. The paint spraying device according to claim 1, wherein a closure element comprises at least one seal element, wherein the at least one seal element is arranged in a recess, as O-ring.

11. The paint spraying device according to claim 10, wherein the closure element comprises two seal elements that are respectively arranged in a recess as an O-ring.

12. The paint spraying device according to claim 1, wherein a structure which projects from a face, is arranged in a region of an internal space, wherein the structure at least partially surrounds a paint inlet opening and generates a flow for continuously circulating the paint in the internal space when the paint spraying device is in operation.

13. The paint spraying device according to claim 12, wherein the structure is a flow deflector or flow collar.

14. The paint spraying device according to claim 1, wherein a flexible diaphragm is circumferentially attached between a housing lower part of the pressure reducer/pressure regulator and a housing cover of the pressure reducer/pressure regulator.

15. The paint spraying device according to claim 14, wherein the flexible diaphragm is clamped or welded between the housing lower part of the pressure reducer/pressure regulator and the housing cover of the pressure reducer/pressure regulator.

16. The paint spraying device according to claim 1, wherein a closure element is formed as a slide or valve element with an internal duct.

17. The paint spraying device according to claim 1, wherein the pressure reducer/pressure regulator is formed as an exchangeable subassembly, with a screw connection and/or a quick-action fastener to the paint inlet line and/or the paint outlet line.

18. The paint spraying device according to claim 1, wherein a diaphragm plate and/or a diaphragm is formed as a one-piece component, wherein rigid constituents are formed with thick walls and flexible constituents are formed with thin walls and/or the diaphragm has, in its outer rim region, a bead or a clamping rim.

19. The paint spraying device according to claim 18, wherein the diaphragm plate and/or the diaphragm is formed as an injection moulded component.

20. The paint spraying device according to claim 1, wherein only a paint supply line and/or only the paint-dispensing line is formed.

21. A paint applying device for applying paint to a substrate, the paint applying device comprising:

one of a paint roller, a paintbrush and a paint pad;

a paint-dispensing line leading to the paint applying device such that the paint-dispensing line is supplied with paint via a paint reservoir and a paint pump; and a pressure reducer/pressure regulator having a paint inlet line for supplying paint at high pressure and a paint outlet line for supplying paint at an essentially constant lower pressure such that the paint inlet line is connected to the paint outlet line via a pressure reducer housing, wherein the pressure reducer/pressure regulator which regulates the paint-dispensing pressure is connected upstream of the paint-dispensing line, and wherein the pressure in the paint-dispensing line is held substantially constant by the pressure reducer/pressure regulator.

* * * * *